US008302618B2

(12) United States Patent
Takanohashi et al.

(10) Patent No.: US 8,302,618 B2
(45) Date of Patent: Nov. 6, 2012

(54) LIQUID TANK CONNECTOR

(75) Inventors: Toshiyuki Takanohashi, Gyoda (JP); Masahiro Hasunuma, Gyoda (JP)

(73) Assignee: Surpass Industry Co., Ltd. (JP)

( * ) Notice: Subject to any disclaimer, the term of this patent is extended or adjusted under 35 U.S.C. 154(b) by 740 days.

(21) Appl. No.: 12/440,509

(22) PCT Filed: Sep. 14, 2007

(86) PCT No.: PCT/JP2007/067928

§ 371 (c)(1),
(2), (4) Date: Aug. 11, 2009

(87) PCT Pub. No.: WO2008/035628

PCT Pub. Date: Mar. 27, 2008

(65) Prior Publication Data

US 2009/0302597 A1 Dec. 10, 2009

(30) Foreign Application Priority Data

Sep. 19, 2006 (JP) ..... 2006-252983

(51) Int. Cl.
*B67D 7/72* (2010.01)
*F16L 37/30* (2006.01)

(52) U.S. Cl. ..... 137/212; 251/149.9

(58) Field of Classification Search ..... 137/212, 137/206, 209; 251/149.9
See application file for complete search history.

(56) References Cited

U.S. PATENT DOCUMENTS

| | | | | |
|---|---|---|---|---|
| 1,245,165 | A * | 11/1917 | Tharp et al. | 137/209 |
| 2,320,969 | A * | 6/1943 | Kromer et al. | 222/61 |
| 2,331,001 | A * | 10/1943 | Simon | 137/212 |
| 2,335,595 | A * | 11/1943 | Kromer et al. | 137/170.2 |
| 4,029,125 | A * | 6/1977 | Steydle et al. | 137/614.06 |
| 2001/0045438 | A1 | 11/2001 | Bilskie et al. | |

OTHER PUBLICATIONS

European Search Report dated Feb. 15, 2011 of Surpass Industry Co., Ltd. for a Liquid Tank Connector, European Application No. EP 07 80 7335.

* cited by examiner

*Primary Examiner* — Craig Schneider
(74) *Attorney, Agent, or Firm* — Thomas W. Tolpin; Tolpin & Partners, PC

(57) ABSTRACT

A liquid tank connector for preventing leakage of contents in a liquid tank when removing a socket from a plug fixed to the liquid tank is provided. The liquid tank connector which includes a plug to be fixed to a liquid tank where liquid is stored, a socket which is able to be connected and disconnected with respect to the plug, and a sleeve for releasing a connected state between the plug and the socket by a relative movement with respect to the socket, and in which a liquid flow channels and gas flow channels are formed in a liquid deliverable state in which the plug and the socket are connected, and which includes: a cock which forms a gas flow channel in the liquid deliverable state, and the relative movement of the sleeve is controlled by the position of the cock in the liquid deliverable state.

3 Claims, 5 Drawing Sheets

LIQUID TANK CONNECTOR

CROSS REFERENCES TO RELATED APPLICATION

This application is a national phase application based upon priority International PCT Patent Application No. PCT/JP2007/067928 filed Sep. 14, 2007, International Publication No. WO 2008/035628 A1 published Mar. 27, 2008, which is based upon priority Japanese Patent Application No. JP 2006-252983, filed Sep. 19, 2006.

TECHNICAL FIELD

The present invention relates to a liquid tank connector for delivering liquid in a liquid tank to the outside.

BACKGROUND OF THE INVENTION

In manufacturing of semiconductors, various chemical agents are used. Such chemical agents are dealt with in a state of being stored in a liquid tank. In semiconductor manufacturing factories equipped with semiconductor manufacturing equipment, the liquid tank is used with a liquid tank connector attached thereto for delivering liquid in the liquid tank to the outside.

FIG. 7 shows a prior art liquid tank with a liquid tank connector attached thereto, such as shown in FIG. 16 of Japanese Unexamined Patent Application Publication No. 2002-114242. The liquid tank 70 is formed with two plugged ports 71, 71*a*. The respective plugged ports 71, 71*a* are fixed with a liquid flow channel connecting plug 72 and a gas flow channel connecting plug 72*a*, respectively. A siphon tube 73 which extends to a position in the vicinity of the bottom of the liquid tank 70 is connected to the liquid flow channel connecting plug 72.

Caps (not shown) are attachable to the respective plugs 72, 72*a*, and the liquid tank 70 is adapted to be transported or stored in a state in which hole portions are closed by the caps.

When taking (delivering) liquid in the interior out from the liquid tank having the configuration as described above, the caps are removed from the respective plugs 72, 72*a* first, and then sockets 75, 75*a* attached to distal ends of hoses 74, 74*a* are connected to the plugs 72, 72*a*, respectively. Then, by activating a pump P provided at the liquid flow channel hose 74, the liquid in the liquid tank 70 is delivered from the siphon tube 73. At this time, since the pressure in the tank assumes a negative pressure by reduction of the liquid in the liquid tank 70, an inert gas is supplied into the liquid tank 70 via the gas flow channel hose 74*a* to compensate the pressure reduction.

PCT International Publication No. WO 2005/119115 describes, a liquid tank connector which is able to deliver liquid and supply inert gas only with one plugged port provided on the liquid tank is disclosed. In other words, the liquid tank connector is adapted to form a liquid flow channel for delivering the liquid in the liquid tank and a gas flow channel for supplying the inert gas into the liquid tank in a state in which one plug and one socket are connected.

SUMMARY DISCLOSURE OF THE INVENTION

However, there is a case in which the socket is removed from the plug for some reason while the liquid is being delivered or while the liquid delivery operation is halted. In such a case, when the liquid in the liquid tank is evaporated and hence the pressure therein is higher than the atmospheric pressure, the gas or the liquid in the liquid tank might leak out.

In view of such circumstances, it is an object of the present invention to provide a liquid tank connector which is adapted to prevent contents in a liquid tank from leaking out when a socket is removed from a plug fixed to the liquid tank.

In order to solve the above-described problem, the liquid tank connector in the present invention employs the following means.

In other words, a liquid tank connector according to the present invention including a plug to be fixed to a liquid tank where liquid is stored; a socket which is able to be connected and disconnected with respect to the plug; and a sleeve mounted to the socket for releasing a connected state between the plug and the socket by a relative movement with respect to the socket, in which a liquid flow channel for delivering liquid from the liquid tank and a gas flow channel for supplying gas into the liquid tank are formed in a liquid deliverable state in which the plug and the socket are connected, and wherein: a cock which forms the gas flow channel in the liquid deliverable state, and the relative movement of the sleeve is controlled by the position of the cock in the liquid deliverable state.

The gas flow channel is formed by operating the cock, and delivery of the liquid is carried out while supplying the gas to the liquid tank. In the present invention, since the relative movement of the sleeve is controlled by the position of the cock in the liquid deliverable state, the socket is never removed from the plug in the liquid deliverable state. Therefore, the socket is prevented from being removed in the liquid deliverable state and in a state in which the interior of the liquid tank is pressurized.

In addition, according to the liquid tank connector in the present invention, the cock forms an exhaust channel for exhausting the gas in the liquid tank out of the liquid tank in a separable state in which the plug and the socket are separable, and allows the relative movement of the sleeve at a position where the exhaust channel is formed.

When removing the socket from the plug, the cock is operated for achieving the separable state. At this time, the exhaust channel is formed and the gas in the liquid tank is exhausted out from the liquid tank, so that a pressurized state in the liquid tank is released. Also, by operating the cock to the position where the exhaust channel is formed, the relative movement of the sleeve is allowed. Therefore, the socket is removed only after the exhaust channel is formed, so that the socket is prevented from being removed with the interior of the liquid tank still pressurized.

In addition, according to the liquid tank connector in the present invention, the cock is rotated between a gas flow channel forming position where the gas flow channel is formed and an exhaust channel forming position where the exhaust channel is formed, and is positioned at the gas flow channel forming position and the exhaust channel forming position.

Since the cock is adapted to be positioned at the gas flow channel forming position and the exhaust channel forming position, the liquid deliverable state and the separable state are reliably realized.

The liquid tank connector in the present invention described above achieves the following specific advantages. Since the socket is prevented from being removed in the liquid deliverable state and also in the state in which the interior of the liquid tank is pressurized by controlling the relative movement of the sleeve by the position of the cock in the liquid deliverable state, leakage of the contents is prevented.

Also, since the exhaust channel for exhausting the gas in the liquid tank out of the liquid tank is formed and the relative movement of the sleeve is allowed at the position where the exhaust channel is formed, the socket is removed only after the exhaust channel is formed, so that the leakage of the contents is prevented.

Also, since the cock is adapted to be positioned at the gas flow channel forming position and the exhaust channel forming position, improved operability is achieved.

A more detailed description of the invention is provided in the following description and appended claims taken in conjunction with the accompanying drawing.

EXPLANATION OF REFERENCE NUMERALS (PART NUMBERS)

Figure 1:
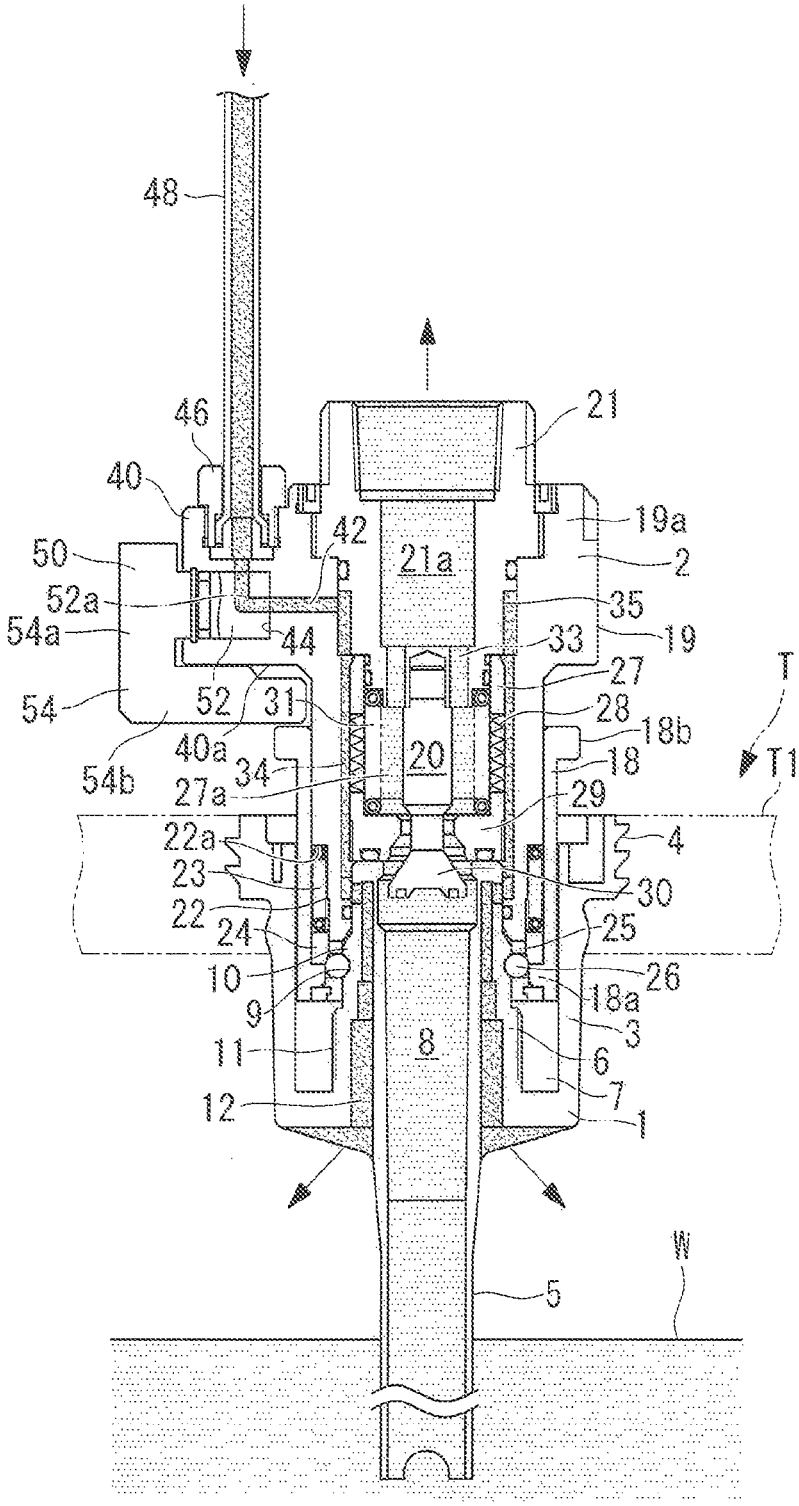
FIG. 1 is a vertical cross-sectional view of a liquid tank connector according to an embodiment of the present invention.

1: plug
2: socket
5: siphon tube
8: through hole (liquid flow channel)
12: gas flow channels (gas flow channels)
18: sleeve
21: liquid flow channel connecting piece
21*a*: inner space (liquid flow channel)
27*a*: inner space (liquid flow channel)
33: liquid channels (liquid flow channels)
34: gas flow channel
35: annular clearance (gas flow channel)
42: gas flow channel
47: exhaust port (exhaust channel)
50: cock
T: liquid tank

DETAILED DESCRIPTION OF THE INVENTION

The following is a detailed description and explanation of the preferred embodiments and best modes contemplated by the inventors of carrying out the invention along with some examples thereof.

Referring to the drawings, embodiments of the present invention will be described below.

In FIG. 1, a cross-sectional view of a liquid tank connector according to the embodiment is shown. As shown in the same drawing, a plug 1 is fixed to an upper wall portion T1 of a liquid tank T, and a socket 2 is connected to the plug 1. Drug solution (liquid) W is stored in the liquid tank T.

The plug 1 is formed of resin and includes a body portion 3 having a cup-shape. A male screw portion 4 is formed on the outer peripheral surface of the body portion 3 for being screwed to the upper wall portion T1 of the tank. A siphon tube 5 formed of resin and extended downward is attached to the center portion of the bottom surface of the body portion 3. The body portion 3 and the siphon tube 5 may be formed integrally, or may be welded together. The siphon tube 5 has a length which allows the lower end thereof to reach a position near the bottom surface of the liquid tank T at attaching.

A plug cylinder 6 extending upright and having a substantially cylindrical shape is provided at the center of a recessed portion 7 of the cup-shaped body portion 3. The plug cylinder 6 is formed with a through hole (liquid flow channel) 8 formed along the center axis, and the through hole 8 is communicated with the siphon tube 5. An annular locking groove 9 and a locking ridge 10 are provided on the outer peripheral surface of the plug cylinder 6 at the midsection in terms of the height thereof. The locking groove 9 is adapted to receive locking balls 26 of the socket 2, described later, fitted thereto. The outer peripheral surface below the locking groove 9 is formed with a male screw portion 11. The male screw portion 11 receives a female screw portion formed on the inner peripheral surface of a cap (not shown) for plugging the through hole 8 of the plug cylinder 6 so as to be screwed thereto. A plurality of gas flow channels 12 formed in the vertical direction are formed on the wall portion of the plug cylinder 6. The lower ends of the gas flow channels 12 are opened to the lower end of the body portion 3, so as to communicate with a gas area formed above the liquid level in the tank T. Also, the upper ends of the respective gas flow channels 12 are opened to the side surface of the upper portion of the plug cylinder 6.

The socket 2 is provided with an inner cylinder 19 having a cylindrical cross section and a cylindrical sleeve 18 provided so as to surround the outer side of the lower portion of the inner cylinder 19.

The sleeve 18 is formed of resin, and is able to move relatively with the inner cylinder 19 in the vertical direction. A flange 18*b* is provided at the upper end of the sleeve 18. The flange 18*b* allows easy griping when moving the sleeve 18 upward. A ball receiving portion 18*a* projecting toward the inner periphery so as to come into abutment with locking balls 26 is provided at the lower end of the sleeve 18. The ball receiving portion 18*a* is used when releasing the locking balls 26.

A shoulder 22*a* formed by cutting the outer periphery away is formed on the lower portion of the inner cylinder 19, so that a thin portion 22 extending from the shoulder 22*a* toward the lower end is provided. A spring 23 is installed on the upper half portion of the thin portion 22, and the upper end of the spring 23 is received by the shoulder 22*a*, and the lower end of the spring 23 is received by a spring receiving ring 24 fitted in the lower portion of the sleeve 18.

The lower half portion of the thin portion 22 positioned on the lower side of the inner cylinder 19 is formed with ball locking holes 25 of a vertically elongated circular shape (not shown) for storing the locking balls 26 at distance in the circumferential direction as appropriate. One each of the locking balls 26 is stored in each ball locking holes 25.

A cylindrical member 27 is stored in the inner cylinder 19 at the midsection in terms of the height thereof. The upper end of the cylindrical member 27 is fixed to a liquid flow channel connecting piece 21 located above. A bellows 28 is provided at the midsection of the cylindrical member 27, so as to be expandable and contractible in the longitudinal (vertical) direction. A valve seat 29 for receiving a valve head 30 is formed below the cylindrical member 27. The valve seat 29 is formed into a cone-shape opened downward, so that the conical surface of the valve head 30 comes into abutment therewith. The valve is opened and closed by the valve head 30 moving toward and away from the valve seat 29. A valve spring 31 is provided on the inner periphery of the cylindrical member 27. The upper end of the valve spring 31 is received by the lower end surface of the connecting piece 21, and the lower end of the valve spring 31 is received by a projecting portion projecting toward the center so as to form the valve seat 29.

The liquid flow channel connecting piece 21 is attached with the lower end thereof stored in a hole portion of the inner cylinder 19. The liquid flow channel connecting piece 21 and the inner cylinder 19 are mounted to the female screw portion formed on the inner peripheral surface of the upper end of the inner cylinder 19 by the male screw portion formed on the outer peripheral surface of the liquid flow channel connecting piece 21 screwed therein. A valve 20 is fixed by screwing to the lower end of the liquid flow channel connecting piece 21 so as to extend downward along the center axial line. A plurality of liquid channels 33 are formed around the valve fixing portion of the liquid flow channel connecting piece 21 in the axial direction. With the liquid channels 33, an inner space (liquid flow channel) 21*a* of the liquid flow channel connecting piece 21 and an inner space (liquid flow channel) 27*a* of the cylindrical member 27 are brought into communication with each other.

As described above, the lower end surface of the liquid flow channel connecting piece 21 presses the valve spring 31 downward. Accordingly, a resilient force of the valve spring 31 is constantly applied to the valve seat 29, so that the valve seat 29 is pressed downward into tight contact with the valve head 30, whereby a liquid seal is achieved. In contrast, when the valve seat 29 is moved apart from the valve head 30 by the valve seat 29 being pressed upward against the resilient force of the valve spring 31, flowing of the liquid is allowed.

A plurality of gas flow channels 34, which are vertical grooves extending in the vertical (axial) direction are formed on the inner peripheral surface of the inner cylinder 19 with which the outer peripheral surface of the cylindrical member 27 is in sliding contact. The lower ends of the gas flow channels 34 are opened when the valve is opened, and are brought into communication with the gas flow channels 12 of the plug 1. The upper ends of the gas flow channels 34 are opened toward an annular clearance 35 formed between the inner peripheral surface of a head portion 19*a* of the inner cylinder 19 and the outer peripheral surface of the connecting piece 21.

A cock mounting portion 40 for mounting a cock 50 is provided on one side of the head portion 19*a* of the inner cylinder 19. The cock mounting portion 40 is formed with a gas flow channel 42 which extends sideward. One end of the gas flow channel 42 is in communication with the annular clearance 35. Also, the other end of the gas flow channel 42 is opened to a storage recess 44 side for storing a shaft portion 52 of the cock 50. A gas flow channel connecting piece 46 is connected to the upper side of the storage recess 44. Gas to be supplied into the liquid tank T is guided by a gas hose 48 mounted to the gas flow channel connecting piece 46.

As shown in FIG. 2, FIG. 3, FIG. 5 and FIG. 6, an exhaust port 47 is formed in the cock mounting portion 40 so as to extend horizontally toward the side. The exhaust port 47 is adapted to be brought into communication with a flow channel of the shaft portion 52 of the cock 50, described later, when exhausting pressurized gas in the liquid tank T.

Figure 4:
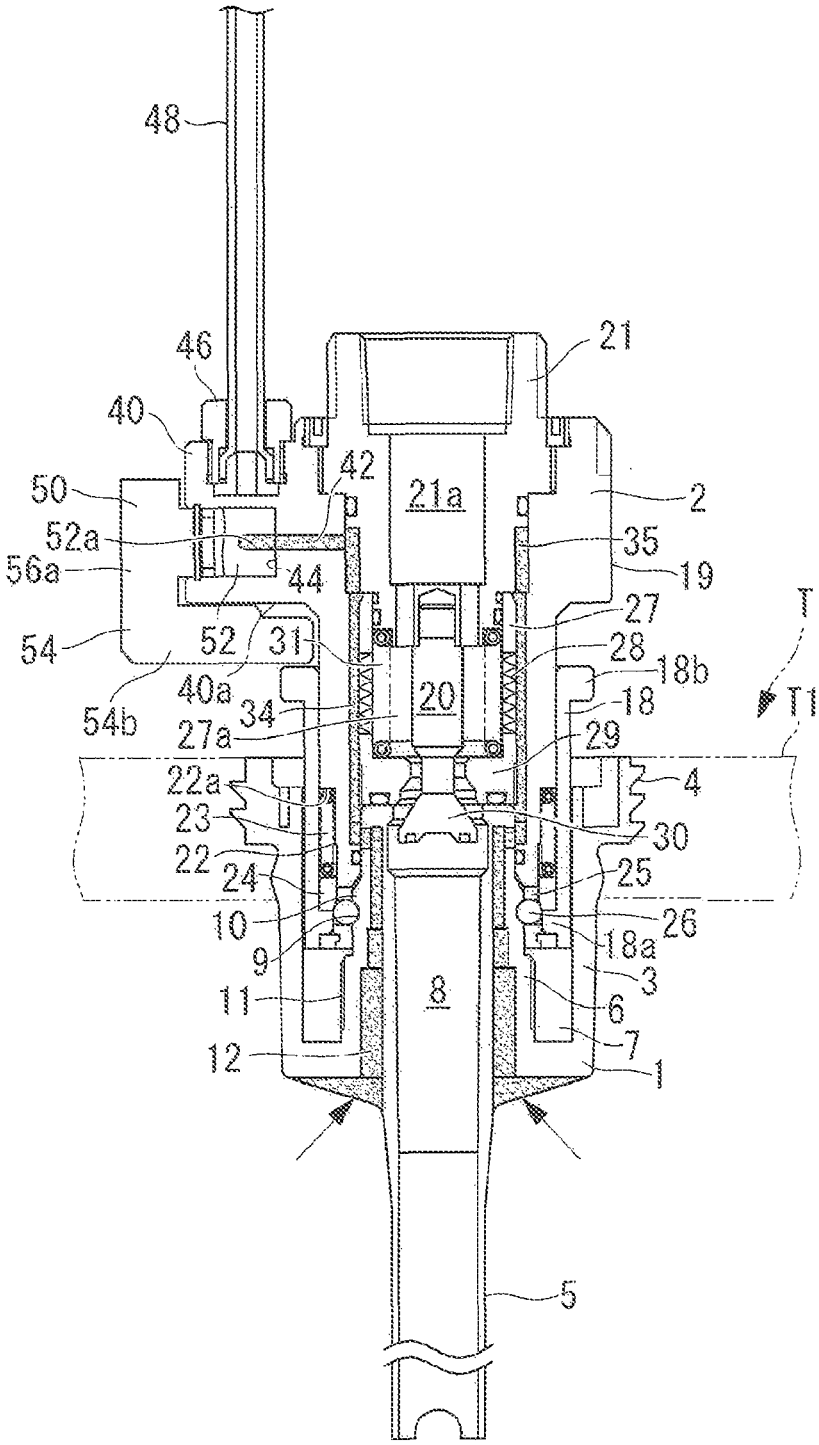
FIG. 4 is a vertical cross-sectional view showing a separable state of the liquid tank connector in FIG. 1.

The cock 50 is attached to the socket 2 by the shaft portion 52 being stored in the storage recess 44. The shaft portion 52 is rotatable about the axial line in the storage recess 44. The shaft portion 52 is formed with a gas flow channel 52*a* which is bent substantially at a right angle. In other words, it has a shape for taking gas supplied from the gas hose 48, bending the flow channel thereof at a substantially right angle, and guiding to the gas flow channel 42 of the cock mounting portion 40. Also, when exhausting the gas in the liquid tank T as shown in FIG. 4, it has a shape for taking the gas flowing from the gas flow channel 42 of the cock mounting portion 40, bending the flow path thereof at a substantially right angle, and discharging the gas to the outside as shown in FIG. 5 and FIG. 6.

A body portion 54 of the cock 50 is a portion to be gripped when operating and, as shown in FIG. 1, is formed into a shape having a L-shaped cross section. In other words, in the liquid deliverable state shown in FIG. 2, it includes a gripping portion 54*a* extending in the vertical direction and a locking portion 54*b* being connected to the lower end of the gripping portion 54*a* and extending horizontally toward the socket 2. The locking portion 54*b* is adapted to enter a space between the upper end of the flange 18*b* of the sleeve 18 and a lower end surface 40*a* of the cock mounting portion 40 in the liquid deliverable state shown in FIG. 1. Accordingly, the upward movement of the sleeve 18 is controlled. The cock 50 is adapted to be reliably positioned by the locking portion 54*b* coming into abutment with the lower end surface 40*a* of the cock mounting portion 40.

The cock 50 is adapted to rotate about 90 degrees about the shaft portion 52. In other words, as is clearly understood from FIG. 2 and FIG. 5, in the liquid deliverable state shown in FIG. 2, the locking portion 54*b* is directed toward 6 o'clock, and in the separable state which allows the plug 1 and the socket 2 to be separated from each other as shown in FIG. 5, the locking portion 54*b* is directed toward 3 o'clock. This allows the locking portion 54*b* to move by a notch 41 (see FIG. 3, for example) formed on the cock mounting portion 40. The cock 50 is adapted to come into abutment at the locking portion 54*b* with an abutment wall 43 provided on the cock mounting portion 40 as shown in FIG. 5 in the separable state shown in FIG. 4, so that the positioning is ensured.

Figure 5:
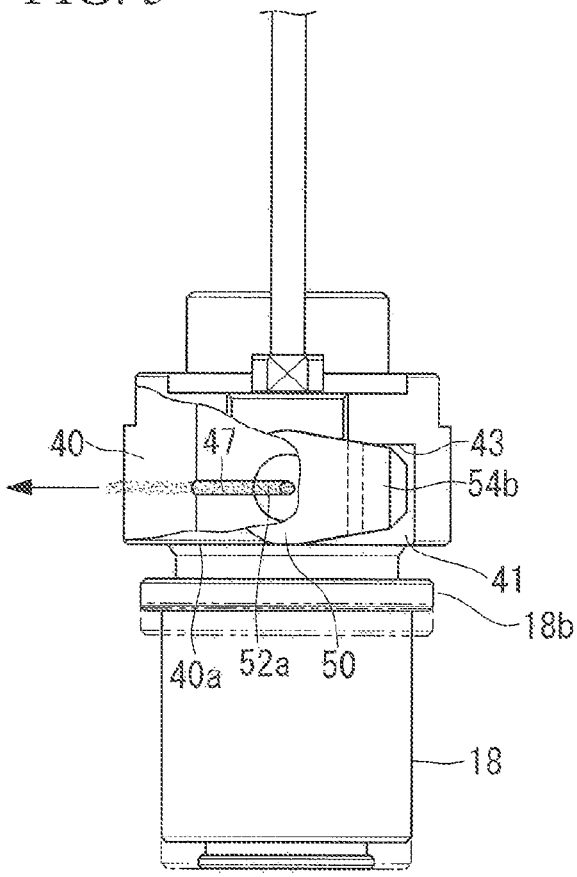
FIG. 5 is a side view showing the socket and the sleeve shown in FIG. 4.
Figure 6:
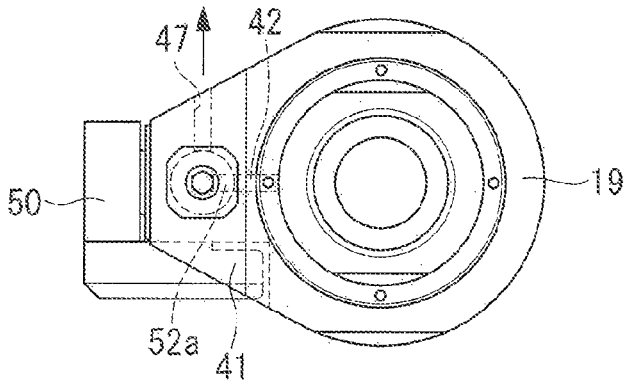
FIG. 6 is a plan view showing the liquid tank connector in FIG. 4.
Figure 7:
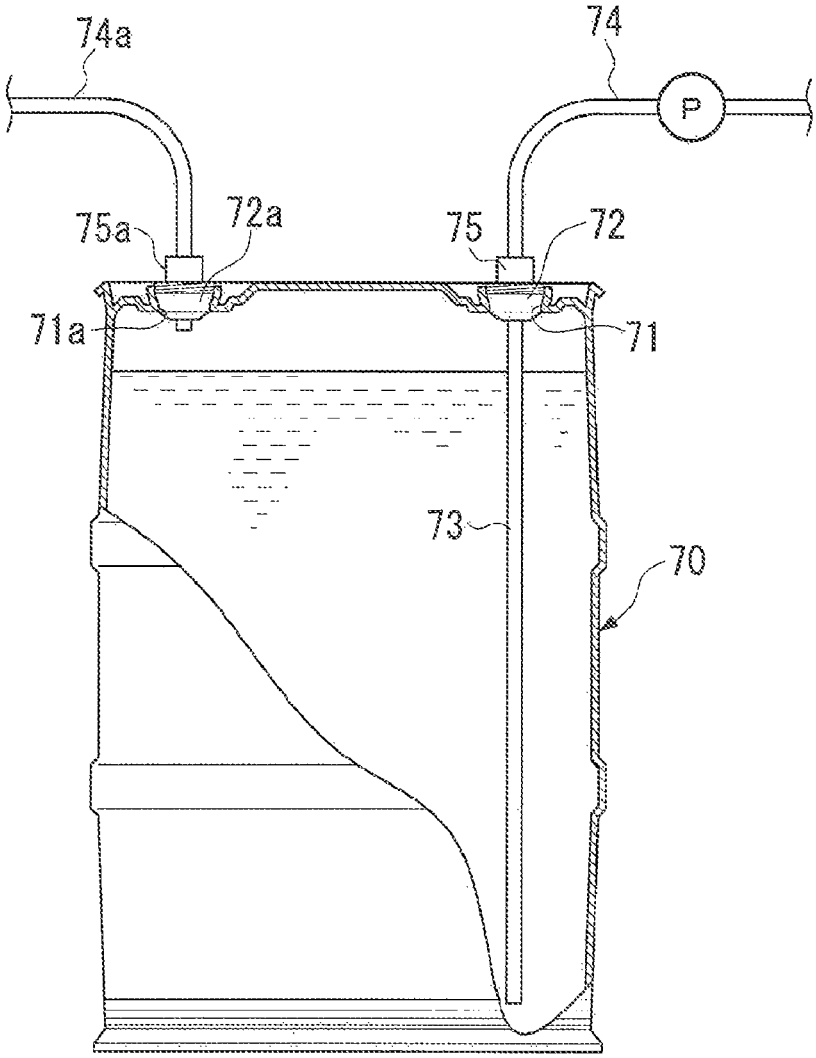
FIG. 7 PRIOR ART
FIG. 7 is a front view showing a liquid tank in the related art.

As shown in FIG. 5, the cock 50 is movable upwardly of the sleeve 18 since the locking portion 54*b* of the cock 50 is retracted from between the upper end of the flange 18*b* of the sleeve 18 and the lower end surface 40*a* of the cock mounting portion 40 in the separable state.

Subsequently, a method of using the liquid tank connector having the configuration as described above will be described.

The distal end of the socket 2 is inserted into the plug 1 screwed into the liquid tank T. Then, the plug cylinder 6 is fitted into the lower portion of the inner cylinder 19 of the socket 2. When the socket 2 is advanced further downward, the locking balls 26 projecting inward from the ball locking holes 25 come into abutment with the locking ridge 10 of the plug cylinder 6 and climb over the locking ridge 10, thereby being fitted into the locking groove 9. With the locking balls 26 fitted into the locking groove 9, the socket 2 is locked and is fixed with respect to the plug 1.

When removing the socket 2 from the plug 1, in order to release the lock, the sleeve 18 is pulled upward with respect to the inner cylinder 19 against the resilient force of the spring 23 while gripping the flange 18*b* of the sleeve 18. Accordingly, the locking balls 26 are pulled upward by the ball receiving portion 18*a* of the sleeve, and the locking balls 26 are released from the locking groove 8, so that the lock is released.

Figure 2:
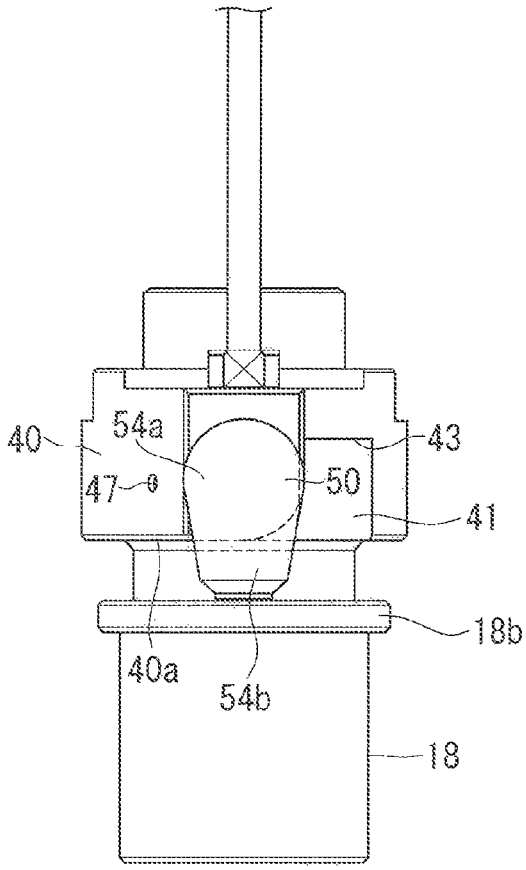
FIG. 2 is a side view of a socket and a sleeve shown in FIG. 1.
Figure 3:
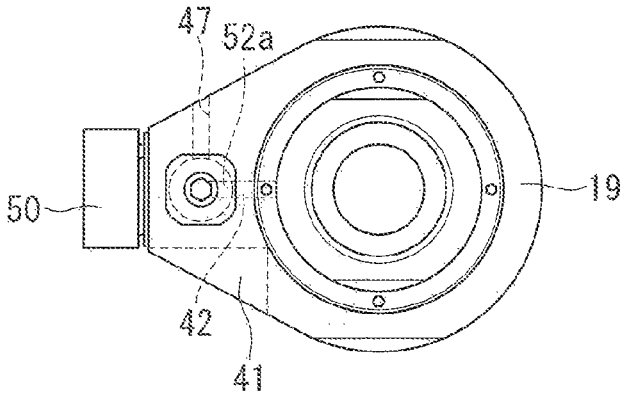
FIG. 3 is a plan view of the liquid tank connector in FIG. 1.

When delivering the liquid, the locking portion 54*b* of the cock 50 is rotated to be directed downward (the position of 3 o'clock) as shown in FIG. 1 to FIG. 3. At this time, the cock locking portion 54*b* comes into abutment with the lower end surface 40*a* of the cock mounting portion 40 (see FIG. 2), and is positioned reliably. Accordingly, the liquid deliverable state is achieved. When the cock locking portion 54*b* is directed downward, the gas flow channel 42 and the gas hose 48 are brought into communication with each other. Accordingly, a gas flow channel composed of the gas hose 48, the gas flow channel 52*a* in the cock shaft portion 52, the gas flow channel 42, the annular clearance 35, the gas flow channels 34 formed on the inner peripheral surface of the inner cylinder 19, and the gas flow channels 12 of the plug 1 is formed.

In a state in which the plug 1 and the socket 2 are connected, the valve seat 29 is pushed upward by the upper end of the plug cylinder 6 and the valve head 30 is moved away from the valve seat 29, so that a liquid flow channel is formed. The liquid flow channel is composed of the siphon tube 5, the through hole 8 of the plug cylinder 6, the inner space 27*a* of the cylindrical member 27, the liquid channels 33 formed around the valve fixing portion of the connecting piece 21, and the inner space 21 a of the connecting piece 21.

In this manner, in the liquid deliverable state in which the locking portion 54*b* of the cock 50 is directed downward, liquid W is taken out from the interior of the liquid tank T through the liquid flow channel and, simultaneously, inert gas is supplied into the liquid tank T through the gas flow channel so as to compensate the content corresponding to the lowering of the liquid level. At this time, since the locking portion 54*b* of the cock 50 is positioned between the upper end of the flange 18*b* of the sleeve 18 and the lower end surface 40*a* of the cock mounting portion 40, the upward movement of the sleeve 18 is blocked. Therefore, the plug 1 and the socket 2 do not come apart.

In order to remove the socket 2 from the plug 1 after having delivered the liquid, first of all, the cock 50 is rotated counterclockwise by 90 degrees to position the locking portion 54*b* of the cock 50 to be directed rightward (position of 3 o'clock). At this time, the cock locking portion 54*b* comes into abutment with the abutment wall 43 (see FIG. 5), and is positioned reliably. Accordingly, the separable state which allows the socket 2 to be separated from the plug 1 is achieved.

When the cock locking portion 54*b* is directed rightward, the gas flow channel 52*a* of the cock shaft portion 52 which has been in communication with the gas hose 48 is directed sideward, so that the communication between the gas hose 48 and the interior of the liquid tank T is blocked. In contrast, since the communication between the gas flow channel 52*a* of the cock shaft portion 52 and the gas flow channel 42 of the cock mounting portion 40 is still maintained, the gas in the liquid tank T is exhausted out from the liquid tank T through the gas flow channel 42, the gas flow channel 52*a* of the cock shaft portion 52, and the exhaust port 47 (see FIG. 4 to FIG. 6).

In this state, since the cock locking portion 54*b* is retracted from between the upper end of the flange 18*b* of the sleeve 18 and the lower end surface 40*a* of the cock mounting portion 40, the upward movement of the sleeve 18 is allowed. In other words, by moving the sleeve 18 relatively upward, the separable state which allows the socket 2 to be removed from the plug 1 is achieved.

As described above, according to the liquid tank connector in this embodiment, the following effects and advantages are achieved.

By placing the locking portion 54*b* of the cock 50 between the upper end of the flange 18*b* of the sleeve 18 and the lower end surface 40*a* of the cock mounting portion 40 in the liquid deliverable state for allowing the liquid to be delivered from the liquid tank T, the upward movement of the sleeve is controlled. Accordingly, in the liquid deliverable state, the socket 2 is constantly prevented from being removed from the plug 1, so that the event such that the socket 2 is removed in the liquid deliverable state and in a state in which the interior of the liquid tank T is pressurized is avoided. Therefore there is no risk of leakage of the contents to the outside when the liquid tank connector is removed.

When bringing into the separable state for removing the socket 2 from the plug 1, the exhaust channel is formed by rotating the cock 50 to bring the gas flow channel 52*a* of the cock shaft portion 52 into communication with the outside of the liquid tank T, so that the gas in the liquid tank T is exhausted out from the liquid tank. Also, the upward movement of the sleeve is allowed by rotating the cock 50 to a position where the exhaust channel is formed and causing the cock locking portion 54*b* to be retracted from between the upper end of the flange 18*b* of the sleeve 18 and the lower end surface 40*a* of the cock mounting portion 40. Therefore, the socket 2 is removed only after the exhaust channel is formed, and the socket 2 is prevented from being removed in the state in which the interior of the liquid tank T is still pressurized.

In the gas flow channel forming position which forms a gas flow channel for supplying gas from the gas hose 48 into the liquid tank T, the cock 50 is reliably positioned by the cock locking portion 54*b* coming into abutment with the lower end surface 40*a* of the cock mounting portion 40. Also, in the exhaust channel forming position which allows gas to be exhausted out from the interior of the liquid tank T to the outside, the cock 50 is reliably positioned by the cock locking portion 54*b* coming into abutment with the abutment wall 43 of the cock mounting portion 40. Therefore, the liquid deliverable state and the separable state which allows the socket to be removed are reliably achieved respectively.

Although embodiments and examples of the invention have been shown and described, it is to be understood that various modifications, substitutions, and rearrangements of parts, components and structural elements, as well as other methods of use can be made by those skilled in the art without departing from the novel spirit and scope of the invention.

The invention claimed is:

1. A liquid tank connector including a plug to be fixed to a liquid tank where liquid is stored; a socket which is able to be connected and disconnected with respect to the plug, and a sleeve mounted to the socket for releasing a connected state between the plug and the socket by a relative movement with respect to the socket, in which a liquid flow channel for delivering the liquid from the liquid tank and a gas flow channel for supplying gas into the liquid tank are formed in a liquid deliverable state in which the plug and the socket are connected, wherein the liquid tank connector includes: a cock which forms the gas flow channel in the liquid deliverable state, and the relative movement of the sleeve is controlled by the position of the cock in the liquid deliverable state.

2. The liquid tank connector according to claim 1, wherein the cock forms an exhaust channel for exhausting the gas in the liquid tank out of the liquid tank in a separable state in which the plug and the socket are separable, and allows the relative movement of the sleeve at a position where the exhaust channel is formed.

3. The liquid tank connector according to claim 2, wherein the cock is rotated between a gas flow channel forming position where the gas flow channel is formed and an exhaust channel forming position where the exhaust channel is formed, and is positioned at the gas flow channel forming position and the exhaust channel forming position.

* * * * *